US009956799B1

(12) United States Patent
Manchester et al.

(10) Patent No.: US 9,956,799 B1
(45) Date of Patent: May 1, 2018

(54) TEST PATTERNS FOR OPTIMIZING NOZZLE ALIGNMENT OF AN INK-JET MARKING ENGINE

(71) Applicants: William Edward Manchester, Erie, CO (US); Mikel John Stanich, Longmont, CO (US)

(72) Inventors: William Edward Manchester, Erie, CO (US); Mikel John Stanich, Longmont, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/413,769

(22) Filed: Jan. 24, 2017

(51) Int. Cl.
*B41J 2/045* (2006.01)
*B41J 29/393* (2006.01)

(52) U.S. Cl.
CPC ..... *B41J 29/393* (2013.01); *B41J 2/04536* (2013.01); *B41J 2/04586* (2013.01)

(58) Field of Classification Search
CPC ... B41J 29/393; B41J 2/04536; B41J 2/04586
USPC ..... 347/14
See application file for complete search history.

(56) References Cited

U.S. PATENT DOCUMENTS

| | | | |
|---|---|---|---|
| 5,451,990 A | 9/1995 | Sorenson et al. | |
| 6,076,915 A | 6/2000 | Gast et al. | |
| 6,310,637 B1 | 10/2001 | Shimada et al. | |
| 6,347,856 B1 | 2/2002 | Arquilevich et al. | |
| 6,755,499 B2 | 6/2004 | Castano et al. | |
| 7,380,897 B2 | 6/2008 | Anderson et al. | |
| 8,292,398 B2 | 10/2012 | Mizes et al. | |
| 8,506,038 B2 | 8/2013 | Mizes et al. | |
| 8,662,625 B2 | 3/2014 | Donaldson | |
| 8,721,033 B2 | 5/2014 | Mongeon et al. | |
| 8,842,330 B1 | 9/2014 | Enge | |
| 9,180,712 B1 | 11/2015 | Stanich et al. | |
| 9,216,603 B1 | 12/2015 | Mizes et al. | |
| 2011/0234676 A1* | 9/2011 | Nishikawa | B41J 2/16579 347/19 |
| 2016/0031238 A1 | 2/2016 | Campbell et al. | |

* cited by examiner

*Primary Examiner* — Huan Tran
*Assistant Examiner* — Alexander D Shenderov
(74) *Attorney, Agent, or Firm* — Duft Bornsen & Fettig LLP

(57) ABSTRACT

Systems and methods are provided for test patterns that detect misalignment. One embodiment is a printer that includes a marking engine having rows of nozzles. The rows are separated along a Y direction, and each row of nozzles extends in an X direction. The printer also includes a controller that directs the marking engine to print multiple bands of a test pattern. Each band is printed by selecting nozzles in a first row, selecting nozzles in a second row that occupy adjacent X positions to the selected nozzles of the first row, and forming a band having multiple marks. Each mark includes a continuous line from a nozzle in the first row and a continuous line from a nozzle in the second row. Each band of the test pattern is printed by ejecting ink from nozzles in a different combination of nozzles.

21 Claims, 14 Drawing Sheets

TEST PATTERNS FOR OPTIMIZING NOZZLE ALIGNMENT OF AN INK-JET MARKING ENGINE

FIELD OF THE INVENTION

The invention relates to the field of printing, and in particular, to aligning nozzles of printers.

BACKGROUND

Print shops generally include high-speed printers used for volume printing. These printers may be capable of printing thousands of pages of content per minute or more. A typical print shop includes multiple production printing systems (e.g., continuous-forms printers). The production printing systems mark a print medium such as paper. When printed content is produced at a high volume, it may be necessary to print batches of hundreds of thousands, if not millions of documents on a regular basis.

In order to provide a desired level of quality, production printing systems include printheads having rows of precisely spaced nozzles for ejecting ink drops onto the print medium. If the spacing between rows of nozzles is not optimized, print quality may be degraded. This typically requires alignment of nozzles so that the printed drops are equally spaced when jetted onto a print medium. Since a row of nozzles is housed within one physical printhead, alignment involves adjusting a rotation or lateral position of the printhead. At a high level, optimal quality is achieved when the printed drops (pels) are accurately located on an ideal square printer grid, where the printer grid is defined as a square lattice of equally spaced points having spacing between lattice points of one divided by the Dots Per Inch (DPI) of the printer. Thus, operators of print shops, to obtain the high image quality that their customers demand, desire accurate alignment of the rows of nozzles in production printers. For at least these reasons, print shop operators continue to seek out enhanced techniques for performing and measuring printhead alignment.

SUMMARY

Embodiments described herein provide systems and methods that utilize enhanced test patterns for detecting and/or quantifying the alignment of rows of nozzles of a production printer. Due to the relative nature of a moving web of paper that travels below the nozzles of a fixed printhead, the physical arrangement of nozzles on a printhead, and jetting times, it is difficult to determine the specific source of error causing variations in the positions of printed pels on print media. When a drop is ejected depends on drop ejection timing for each of multiple nozzles. The nozzles of the printhead are arranged in a regular pattern, where nozzles are placed into rows. Each row may have nozzles that are staggered in a cross-process direction with respect to other rows. The contributions from these different sources of error are combined in a complex manner. Specifically, the test patterns herein are designed such that printhead misalignment with respect to the print media web direction causes specific portions of the printed test pattern to be distorted in an easily detectable manner. The web direction is defined as the direction formed by tracking a single point on the web as it translates through the print engine in the area where the printhead ejects ink onto the moving web. The test patterns, when represented precisely on an ideal printer grid, are not distorted. It is the degree to which the printed test patterns are distorted that is used to gauge the accuracy of the alignment.

A further objective of the test pattern arrangements is to allow for identifying the contributions of different sources of pel misplacement, such as the error caused by print media web direction misalignment, printhead array misalignment, and individual printhead alignment. The distortion of the printed result is unique for a specific error source. Identifying the unique signature present in the printed result allows one to identify misalignment produced by each of the misalignment contributors. For example, these test patterns may enable a service engineer to visually determine whether rows of nozzles of the printhead are properly aligned with respect to print media, without the need for a magnifying device. These test patterns may facilitate "naked eye" determination of printhead alignment even for printers having a resolution of 1200 dots per inch (DPI) and above.

Creating a test pattern that when printed can be interpreted without assistance from a magnifying device involves selection of patterns that have high and low contrast sensitivity to the human eye. Low contrast sensitivity is used in the patterns to cause blurring when viewed, and high contrast sensitivity is used as a mechanism to enable detection of alignment errors. Employing a measurement device to quantify the error can allow a specific correction to be applied to the device to achieve the correct alignment. The device may analyze the same visual characteristics in a printed test pattern, permitting low resolution scanners or even densitometers to be used to determine printhead alignment. This results from such "blurred" patterns not requiring high spatial resolution to be analyzed. At the same time, such devices may be sensitive enough to detect contrast variations on the printed test pattern.

One embodiment is a system that includes a printer. The printer includes a marking engine having rows of nozzles that eject ink onto a print medium. The rows are separated from each other along a Y direction, and each row of nozzles extends in an X direction that is in-plane with the Y direction. The printer also includes a controller that directs the marking engine to print multiple bands of a test pattern. Each band is printed by selecting nozzles in a first row at regularly spaced intervals, selecting nozzles in a second row that occupy adjacent X positions to the selected nozzles of the first row, and ejecting continuous lines of ink from the selected nozzles in the first row and the selected nozzles in the second row onto a print medium to form a band having multiple evenly spaced marks separated by empty space, each mark including a continuous line from a nozzle in the first row and a continuous line from a nozzle in the second row. Each band of the test pattern is printed by ejecting ink from nozzles in a different combination of nozzles.

Another embodiment is a method that includes selecting a marking engine comprising rows of nozzles that eject ink onto a print medium, wherein the rows are separated from each other along a Y direction, and each row of nozzles extends in an X direction that is in-plane with the Y direction. The method also includes directing the marking engine to print multiple bands of a test pattern, wherein each band is printed. This is performed by selecting nozzles in a first row at regularly spaced intervals, selecting nozzles in a second row that occupy adjacent X positions to the selected nozzles of the first row, and ejecting continuous lines of ink from the selected nozzles in the first row and the selected nozzles in the second row onto a print medium to form a band comprising multiple evenly spaced marks separated by empty space. Each mark includes a continuous line from a nozzle in the first row and a continuous line from a nozzle in the second row. Each band of the test pattern is printed by ejecting ink from nozzles in a different combination of nozzles.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
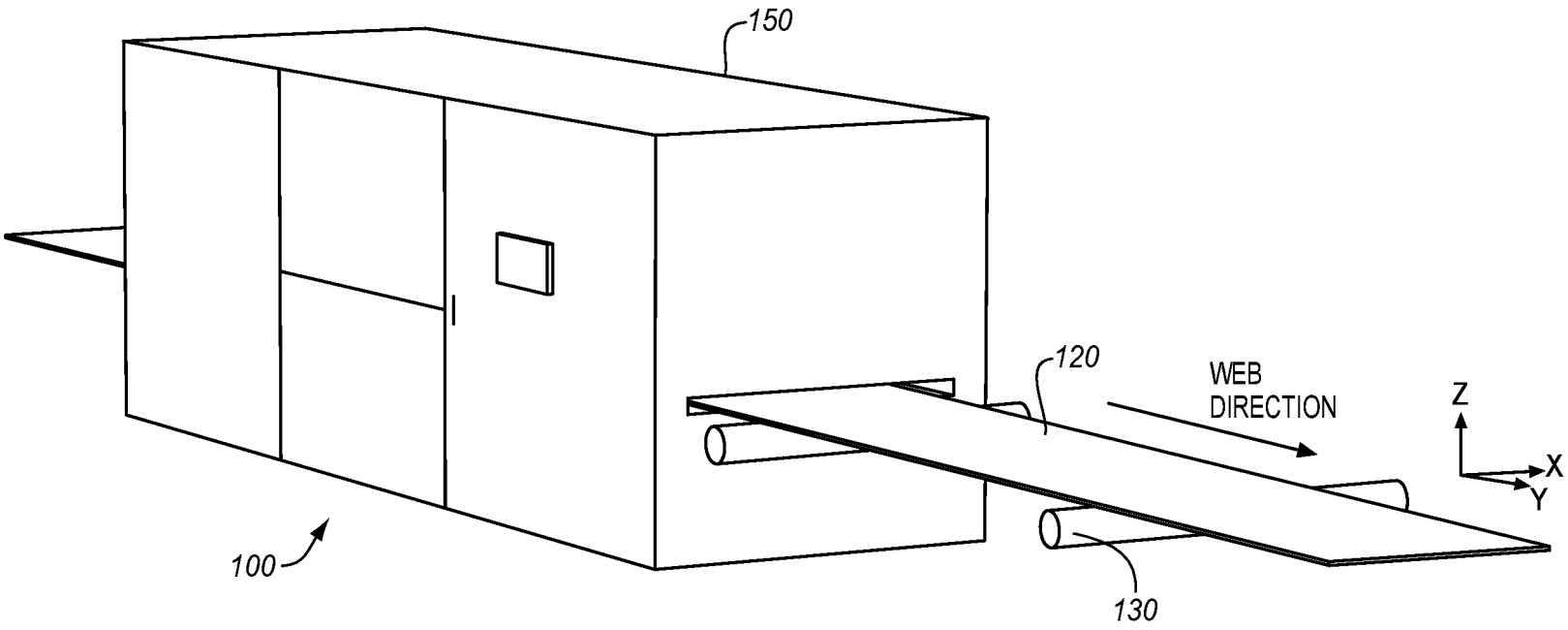
FIG. 1 is a diagram of a printing system in an exemplary embodiment.

FIG. 1 is a diagram of a printing system 100 in an exemplary embodiment. In this embodiment, printing system 100 comprises a continuous-forms printer 150. In further embodiments printer 150 may comprise a cut-sheet printing system, wide format printing system, etc. Printer 150 applies marks to a web 120 of continuous-forms print media (e.g., paper). The applied marking material may comprise ink in the form of any suitable fluid (e.g., aqueous inks, oil-based paints, additive manufacturing materials, etc.) for marking web 120. One or more rollers 130 position web 120 as it travels through printing system 100. FIG. 1 illustrates a direction in which web 120 travels during printing (Y) (i.e., a direction that proceeds along a length of web 120), a lateral direction (X) perpendicular to a Y direction (i.e., a direction that proceeds along the width of web 120), and a direction Z. The Y direction and the X direction may also be known as the "process direction" and "cross-process direction," respectively.

Figure 2:
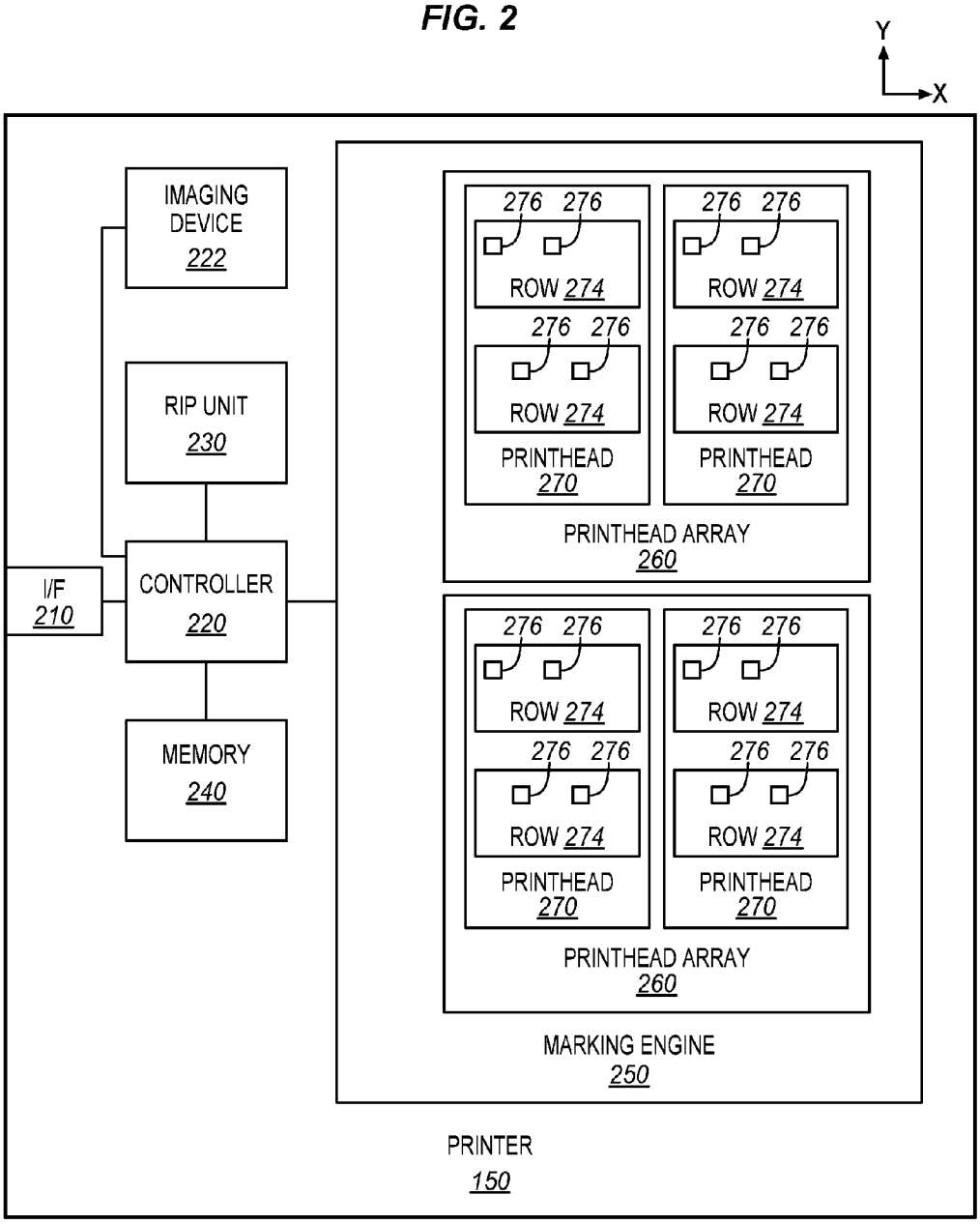
FIG. 2 is a block diagram of a printer in an exemplary embodiment.

FIG. 2 is a block diagram of printer 150 in an exemplary embodiment. Printer 150 includes interface (I/F) 210 for receiving print data for printing. Controller 220 stores incoming print data (e.g., Page Description Language (PDL) print data) in memory 240. This data may be rasterized by Rasterization Image Processor (RIP) unit 230 into bitmap data and stored in memory 240 (or a separate print spool). Based on stored bitmap data, controller 220 provides marking instructions to marking engine 250. I/F 210 may comprise any suitable data interface, such as an Ethernet interface, Universal Serial Bus (USB) interface, etc. Controller 220 may be implemented as custom circuitry or as a processor executing programmed instructions, etc.

Marking engine 250 comprises multiple printhead arrays 260. Each array 260 may include multiple printheads 270. Each printhead 270 includes multiple rows 274 of nozzles 276, which are separated along the Y direction and each discharge/eject drops of ink onto print media 120. In this embodiment, printheads 270 are fixed during the operation of printer 150. Thus, each nozzle 276 at a printhead 270 consistently marks a specific, predefined location along the X direction. During printing, bitmap data defines which of nozzles 274 eject ink, thereby converting digital information into printed images on web 120. Each array 260 may comprise printheads 270 that form one or more color planes for printer 150, such that one array 260 includes all nozzles that discharge Cyan (C) ink, one array 260 includes all nozzles that discharge Yellow (Y) ink, one array 260 includes all nozzles that discharge Magenta (M) ink, and one array 260 includes all nozzles that discharge Black (K) ink. In a further embodiment, one array 260 includes C and K nozzles, while another array 260 includes M and Y nozzles. In still further embodiments, each printhead array 260 or printhead 270 may include any suitable combination of CMYK colors.

Imaging device 222 acquires images of printed portions of web 120, which may be analyzed by controller 220 to detect misalignment and analyze print quality. Imaging device 222 may comprise a camera, scanner, densitometer, spectrophotometer or other suitable component for acquiring images of printed content.

The particular arrangement, number, and configuration of components described herein is exemplary and non-limiting. Illustrative details of the operation of printing system 100 will be discussed with regard to FIG. 3. Assume, for this embodiment, that a print shop operator or technician has finished installing a new set of printheads 270 at printer 150.

The print shop operator then attempts to determine whether or not rows 274 of nozzles 276 at printer 150 are properly aligned. In order to detect misalignment (e.g., angular skew with respect to the print medium or a positional displacement), the print shop operator directs printer 150 to print a test pattern that allows for quick visual identification of whether or not a row 274 of nozzles 276 is misaligned with regard to print media 120 web direction. If the test pattern indicates misalignment, this means that either a row 274 of a printhead 270 is misaligned, or web 120 direction is misaligned (e.g., skewed) relative the desired web direction for the printer in the area where the printheads being tested are located.

Figure 3:
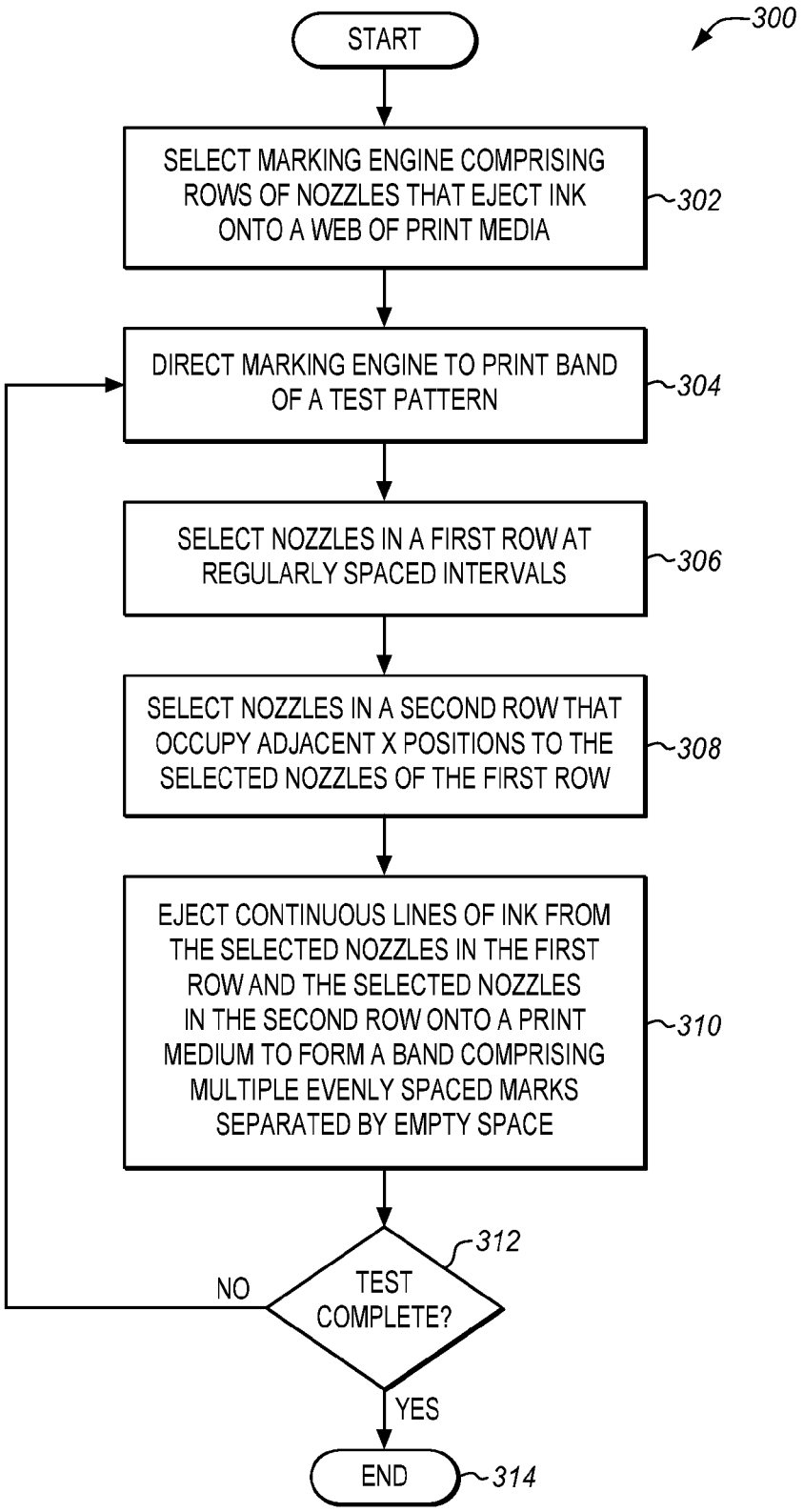
FIG. 3 is a flowchart illustrating a method for operating a printer in an exemplary embodiment.

FIG. 3 is a flowchart illustrating a method 300 for operating a printer in an exemplary embodiment. The steps of method 300 are described with reference to printing system 100 of FIG. 1, but those skilled in the art will appreciate that method 300 may be performed in other systems such as cut-sheet or wide-format printing systems. The steps of the flowcharts described herein are not all inclusive and may include other steps not shown. The steps described herein may also be performed in an alternative order.

Controller 220 receives input from the print shop operator via I/F 210 requesting that a test pattern be printed at printer 150. Controller 220 proceeds to select marking engine 250 for printing the test pattern (step 302). In a further embodiment, where printer 150 includes multiple marking engines, controller 220 may select any suitable combination of marking engines for testing. Such a selection may be performed based on user input from the print shop operator, criteria stored in memory 240, or any desired metric.

With a marking engine selected, controller 220 proceeds to generate print data defining a test pattern that comprises multiple bands that extend along the X direction and are separated along the Y direction. After the test pattern is generated, controller 220 stores the test pattern in memory 240.

Controller 220 then directs marking engine 250 to print a band of the test pattern (step 304). Each band of the test pattern includes evenly spaced marks that are separated by empty space along the X direction. Each mark will be printed by a pair of nozzles 276 that are adjacent in the lateral direction (the X direction) but occupy different rows 274 in the Y direction. Thus, the process of printing a band of the test pattern includes controller 220 selecting nozzles in a first row at regularly spaced intervals (e.g., each nozzle in the row, or every Nth nozzle in the row) (step 306). Controller 220 further selects nozzles in a second row that occupy adjacent X positions to the selected nozzles of the first row (step 308). The second row and first row occupy different positions along the Y axis. As used herein, the "first" row and "second" row need not occupy adjacent Y positions. In one embodiment, the nozzles of the first row and the second row are staggered with respect to each other such that in a group of multiple rows at a printhead 270, each nozzle of the group is located at a unique X position. In another embodiment, the nozzles of the first row and second row are not staggered with respect to each other such that in a group of multiple rows at a printhead 270, some nozzles of the group may have the same X position. In that case, selecting a nozzle in a second row that occupies an adjacent X position may necessitate not selecting a nozzle in the second row that has the same X position.

Controller 220 continues by directing marking engine 250 to eject ink drops forming continuous lines of ink from the selected nozzles in the first row and the selected nozzles in the second row onto the print medium (e.g., web 120) (step 310). This forms a band that includes multiple evenly spaced marks separated by empty space. If all bands of the test pattern have been printed and the test pattern has been repeated a desired number of times (step 312), then the process completes and printing of the test pattern halts (step 314). Alternatively, if bands remain to be printed, processing returns to step 304 to print a new band further down the web in the web direction. Each band of the test pattern is printed by ejecting ink from different combinations of nozzles. For example, in this embodiment, each band is printed by ejecting ink from different combinations of rows. Thus, for a four-band test pattern, each of the four bands comprises ink from a different combination of nozzles (e.g., ink from nozzles at a different and/or unique combination of rows). The test pattern may repeat any suitable number of times along the Y direction. For example, a 4-band test pattern may be repeated N times in order to yield a N*4 total printed bands.

Further details of the arrangement of nozzles and the generation of test patterns is described in detail with regard to the following FIGS. In one embodiment, printheads 270 remain stationary (e.g., because they are fixed in place on printer 150) as the test pattern is printed onto web 120. The test pattern is then reviewed to determine whether or not any rows of nozzles and/or printheads are misaligned relative to web 120. Even in systems where a printhead occasionally moves during normal printing, the test patterns described herein may be printed while the printheads remain stationary. Thus, causing the printheads to remain stationary during printing of the test patterns described herein may optionally be performed as an active step.

In previous systems, comb patterns were implemented at a single pel of width, and would have to be painstakingly manually inspected for discrepancies in spacing via a magnifying device. The test patterns described herein take advantage of that fact that when viewed at a normal reading distance (e.g., fifteen to twenty five inches), the marks in each band appear to blend together. This causes each band to appear as a continuous density due to blurring. As used herein, "density" refers to the apparent darkness of a band. If the printheads are properly aligned, all bands of these new test patterns appear to be the same density, as each band includes the same ratio of inked print media to empty space. However, if a printhead is misaligned, overlap occurs between nozzles of different rows. Since each mark is printed via nozzles of different rows, the thickness of marks changes between bands when there is misalignment. This means that the density of bands in the test pattern changes. One band has a higher ratio of inked print media to empty space, the next band has a lower ratio of inked print media to empty space, and so on in an alternating fashion. The apparent density of the test pattern noticeably changes between bands in an alternating fashion, instead of appearing consistent between bands. Thus, a print shop operator or maintenance personnel may determine that a printhead (or row of nozzles) is misaligned upon determining that the bands alternate in apparent density, and may do so without resorting to using a magnifying device. The precise reasons for this phenomenon are discussed below in detail.

Figure 4:
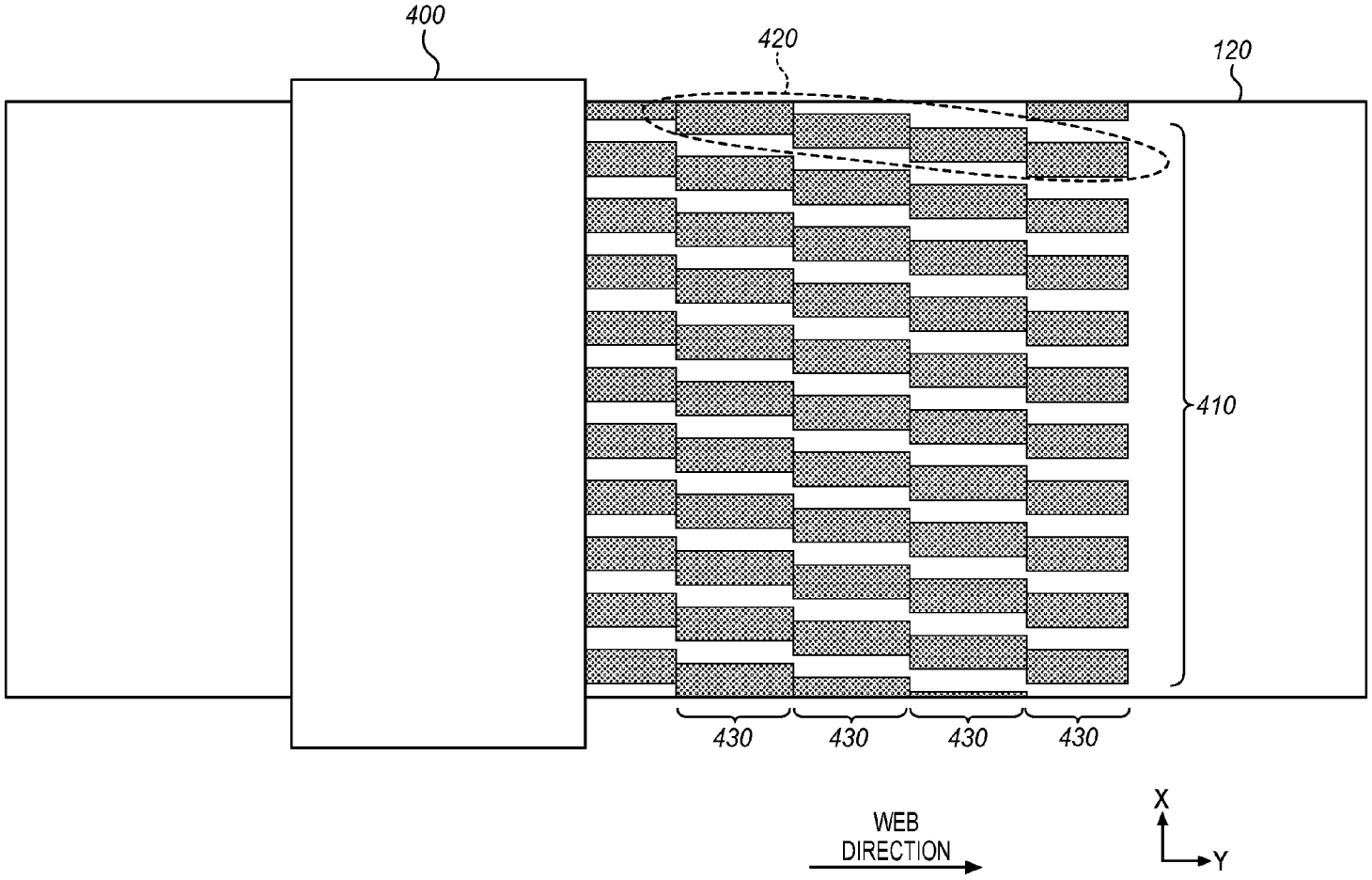
FIG. 4 is a diagram illustrating a printhead printing a repeating test pattern onto a web of print media in an exemplary embodiment.

FIG. 4 is a diagram illustrating a printhead 400 printing a repeating test pattern 420 onto a web 120 of print media in an exemplary embodiment. Specifically, FIG. 4 illustrates printhead 400, which discharges ink onto web 120 as web 120 proceeds in a web direction. The discharged ink forms a test pattern 420, comprising multiple bands 430. Test pattern 420 repeats throughout region 410. Region 410 may span the entire width of printhead 400, so as to use all of the nozzles in the printhead.

Figure 5:
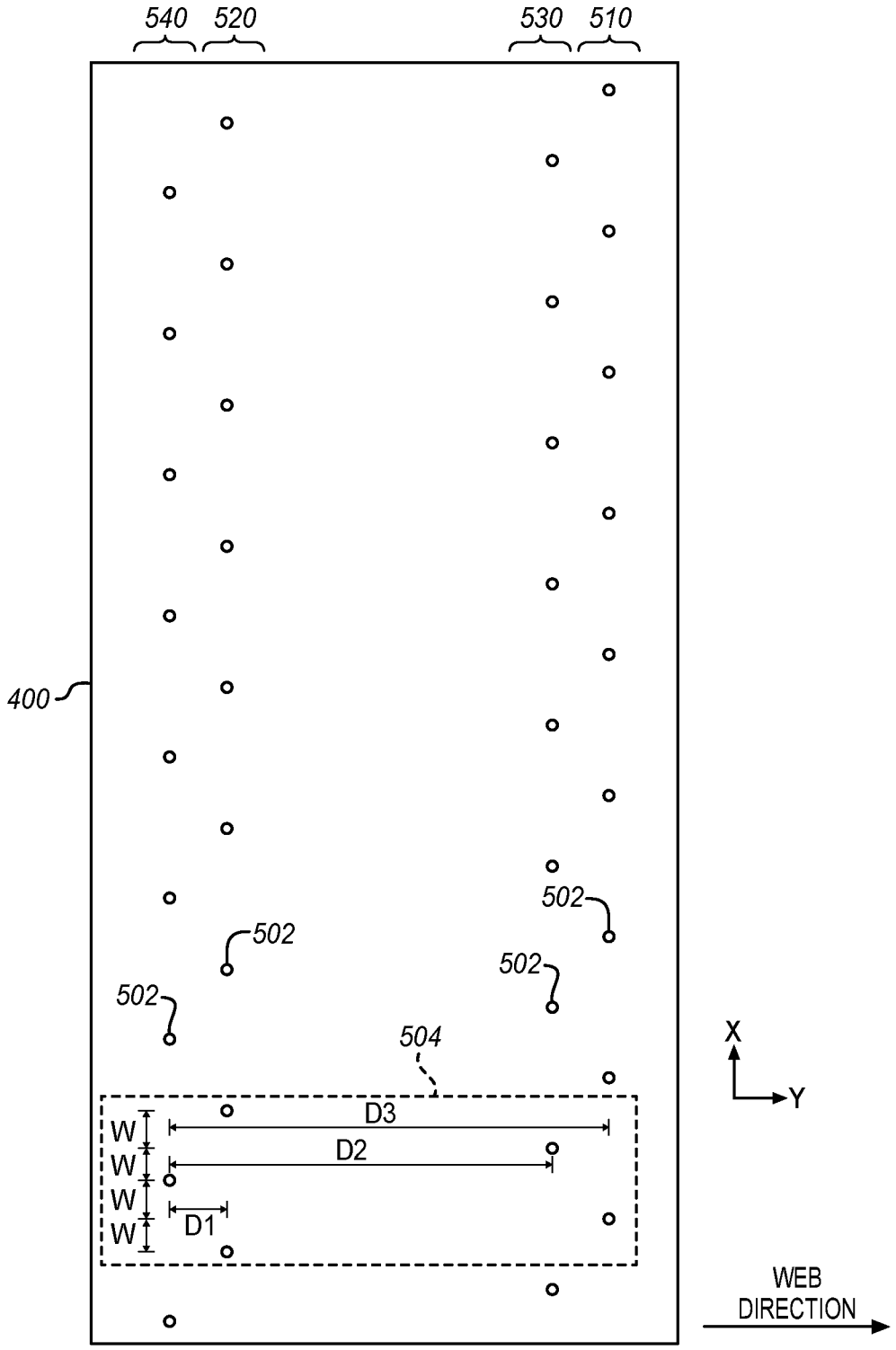
FIG. 5 is a diagram illustrating rows of nozzles at a printhead in an exemplary embodiment.

FIG. 5 illustrates further details of printhead 400 of FIG. 4. Specifically, FIG. 5 is a diagram illustrating rows (510, 520, 530, 540) of nozzles 502 at printhead 400 in an exemplary embodiment. In further embodiments a printhead may include any suitable number of rows. According to FIG. 5, each row is separated from each other row along the Y direction. Furthermore, nozzles 502 that are adjacent to each other with respect to the X direction occupy different rows, and therefore have different positions along the Y direction. For example, proceeding from top to bottom, adjacent nozzles 502 along the X direction occupy rows 510, 520, 530, and 540 in a repeating pattern. Nozzles 502 are therefore evenly spaced along the X direction. Phrased in another way, rows of the marking engine are staggered such that in a group comprising rows 510, 520, 530, and 530, each nozzle of the group is located at a unique X position. Considering a system which includes CMYK, there may be four nozzles in a given X position, one nozzle per color C, M, Y, and K.

Figure 6:
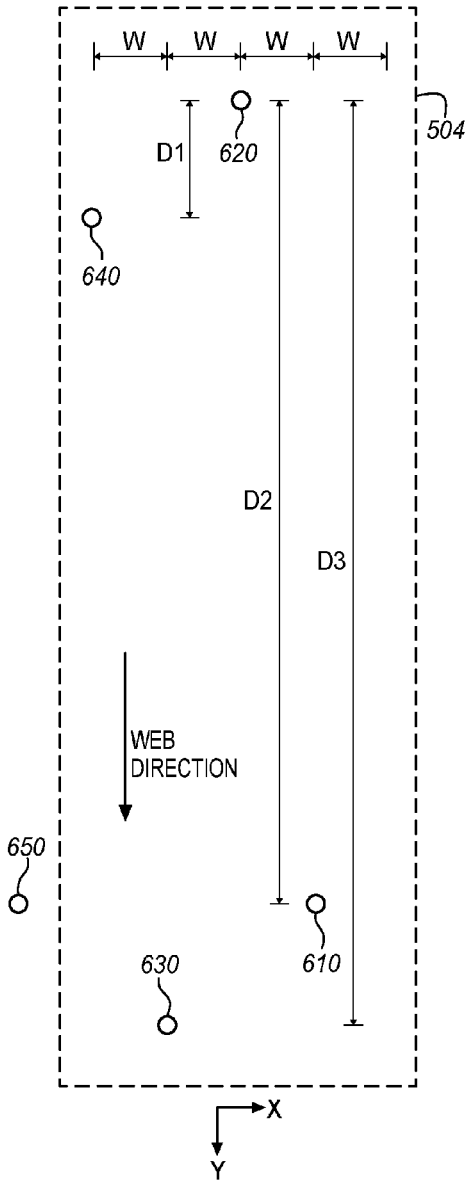
FIG. 6 is a diagram further illustrating nozzles at a printhead in an exemplary embodiment.

Region 504 of printhead 400 includes nozzles 502 that eject/discharge lines of ink to form a single instance of test pattern 420. In this embodiment, each nozzle 502 in region 504 is separated from adjacent nozzles 502 along the X direction by distance W. Row 540 occupies a position with the lowest Y value. The distance from row 540 to row 520 is D1, the distance from row 540 to row 530 is D2, and the distance from row 540 to row 510 is D3. FIG. 6 illustrates a further view of region 504 of printhead 400 (rotated 90° from FIG. 5), and further individually labels nozzles 610, 620, 630, and 640, which each occupy a different row.

Figure 7:
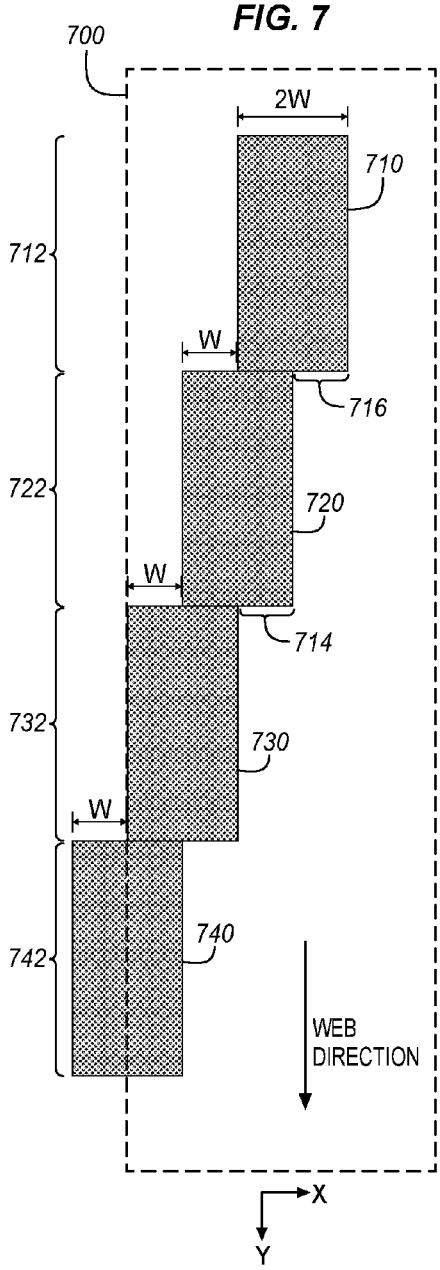
FIG. 7 is a diagram illustrating a partial test pattern printed by the nozzles of FIG. 6 in an exemplary embodiment.

In an ideally aligned printhead, region 504 generates partial test pattern 700 of FIG. 7. As used herein, a "partial" test pattern is a selected portion of a full test pattern. Partial test patterns are provided in the following FIGS. to emphasize changes in nozzle position that occur when a row of nozzles is misaligned with regard to a web of print media. In partial test pattern 700, the center point of each mark (710, 720, 730, 740) is separated by distance W along X, and each mark occupies a different range of positions along the Y direction. Marks 710, 720, 730, and 740 are jointly formed by combinations of nozzles 610, 620, 630, 640 and 650. Mark 710 is formed jointly by ink from nozzles 610 and 620. Mark 720 is formed by ink from nozzles 620 and 630. Mark 730 is formed by ink from nozzles 630 and 640. Mark 740 is formed by ink from nozzles 640 and 650, nozzle 650 being located in the same row as nozzle 610. Mark 710 is located within band 712 along the Y axis, mark 720 is located within band 722 along the Y axis, mark 730 is located within band 732 along the Y axis, and mark 740 is located within band 742 along the Y axis. In the figures, the printed marks described here are not shown to scale and have simplified geometries in order to enhance ease of viewing. Ink drop size and shape in addition to media dot gain and other factors may cause printed mark detail variations that are not shown in the figures.

As discussed above, nozzles at the printhead that are adjacent along the X direction occupy different rows. Each nozzle of the pair of nozzles ejects a continuous line of ink that occupies multiple bands, and the marks in each band are staggered with respect to neighboring bands. When fully printed to form a full test pattern, a portion of each mark will extend twice as far along the Y axis, and hence overlap another mark. For example, if mark 720 is split into contiguous halves (714, 716) along the X direction, one half of mark 720 in the full test pattern will extend in the direction of travel (Y) to overlap mark 710 in band 712, and the other half of mark 720 in the full test pattern will be extended in the direction of travel to overlap mark 730 in band 732. In this manner, neighboring bands (i.e., bands that are adjacent along the Y direction) are printed by different pairs of nozzles that are adjacent along the X direction, and neighboring bands have at least one nozzle in common.

Phrased another way, a nozzle at a first row may print a line extending across two marks in two bands (and therefore forming a part of both of those marks), and a second nozzle at a second row may print a line across two other marks. Thus, for each mark in the completed test pattern, a first half of a mark in the lateral direction (X) will comprise ink applied by a first nozzle of a pair of adjacent nozzles, and a second half of the mark in the lateral direction will comprise ink applied by a second nozzle of the pair.

Figure 8:
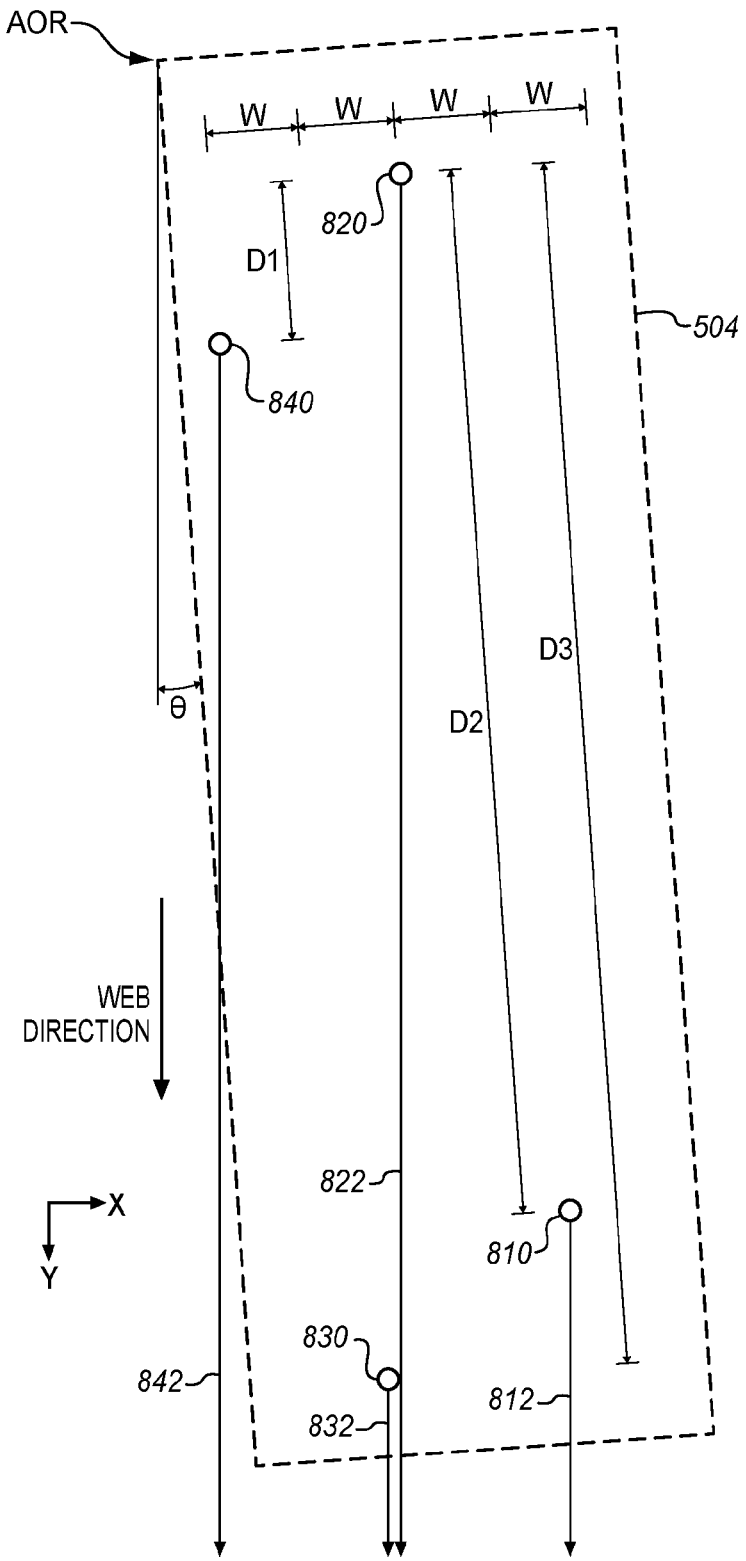
FIG. 8 is a diagram illustrating nozzles at a misaligned printhead in an exemplary embodiment.
Figure 9:
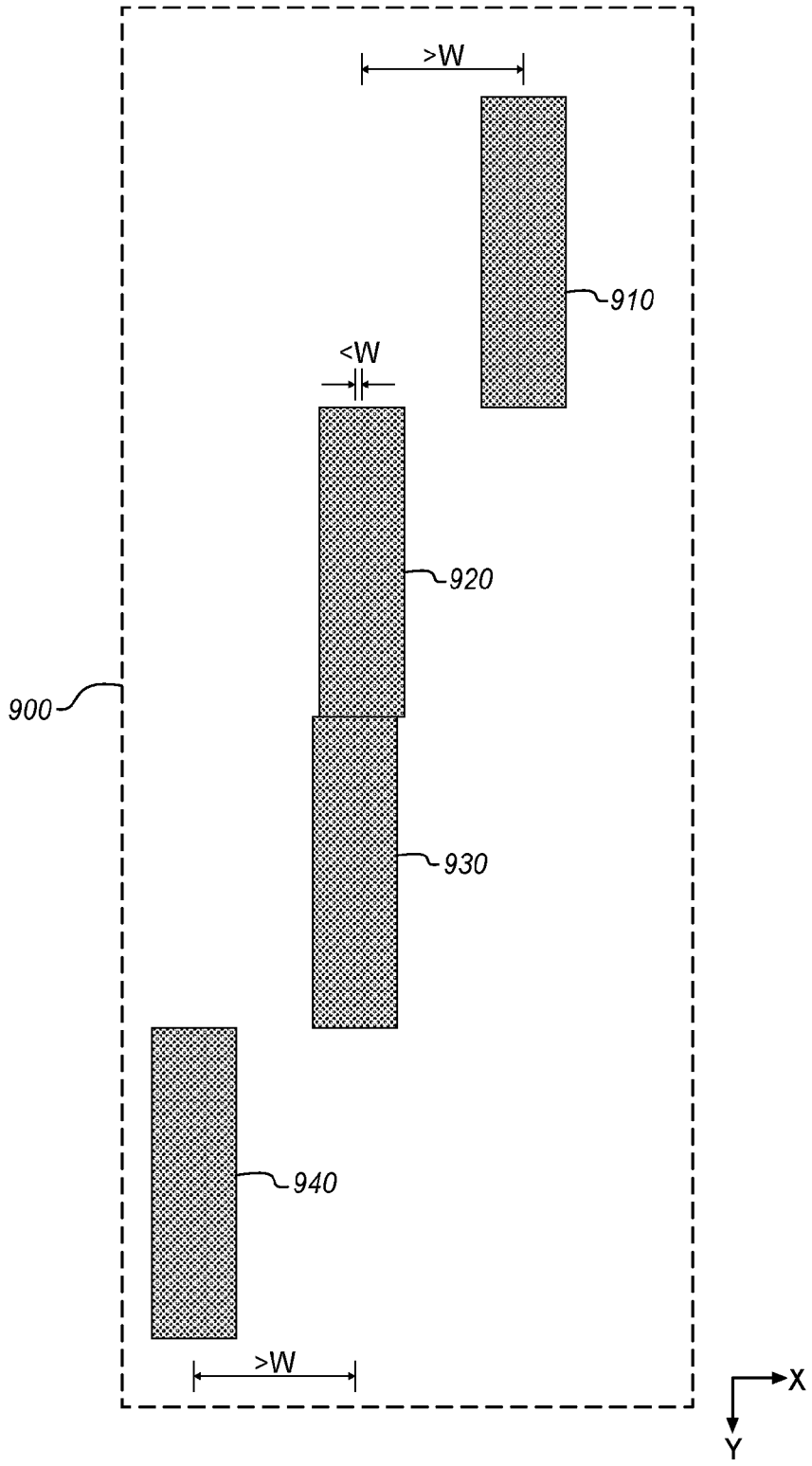
FIG. 9 is a diagram illustrating a partial test pattern printed by the nozzles of FIG. 8 in an exemplary embodiment.

FIG. 8 is a diagram illustrating nozzles at a misaligned printhead in an exemplary embodiment. In this embodiment, region 504 is misaligned counterclockwise about the Z axis by some amount 8 about an Axis of Rotation (AOR) relative to web direction for web 120. This means that nozzles 810, 820, 830, and 840 discharge ink onto a web of print media as indicated by lines 812, 822, 832, and 842 respectively. This results in nozzle 810 depositing ink 910, nozzle 820 depositing ink 920, nozzle 830 depositing ink 930, and nozzle 840 depositing ink 940, respectively, at partial test pattern 900 of FIG. 9. As shown in FIG. 9, lines 910-940 are no longer evenly spaced along the X direction.

Figure 10:
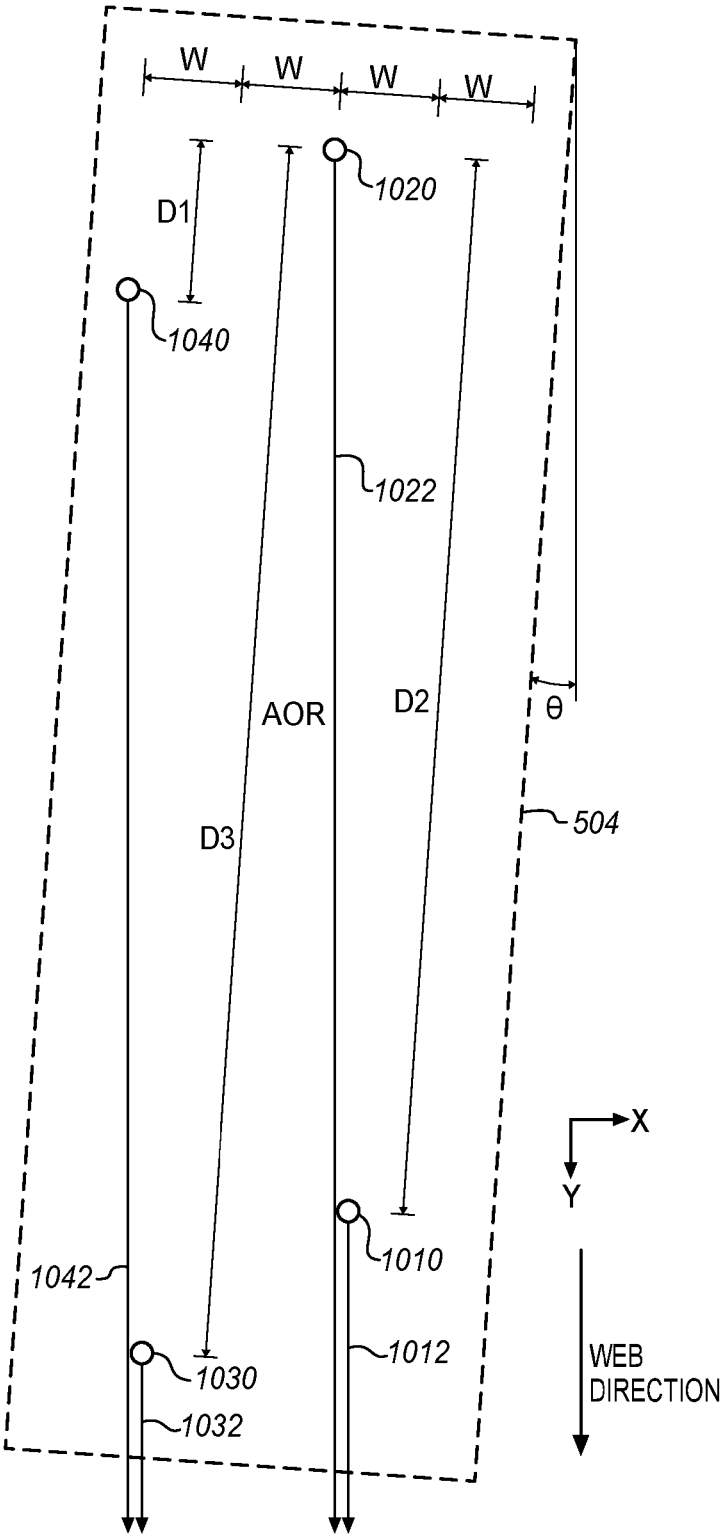
FIG. 10 is a diagram illustrating nozzles at a further misaligned printhead in an exemplary embodiment.
Figure 11:
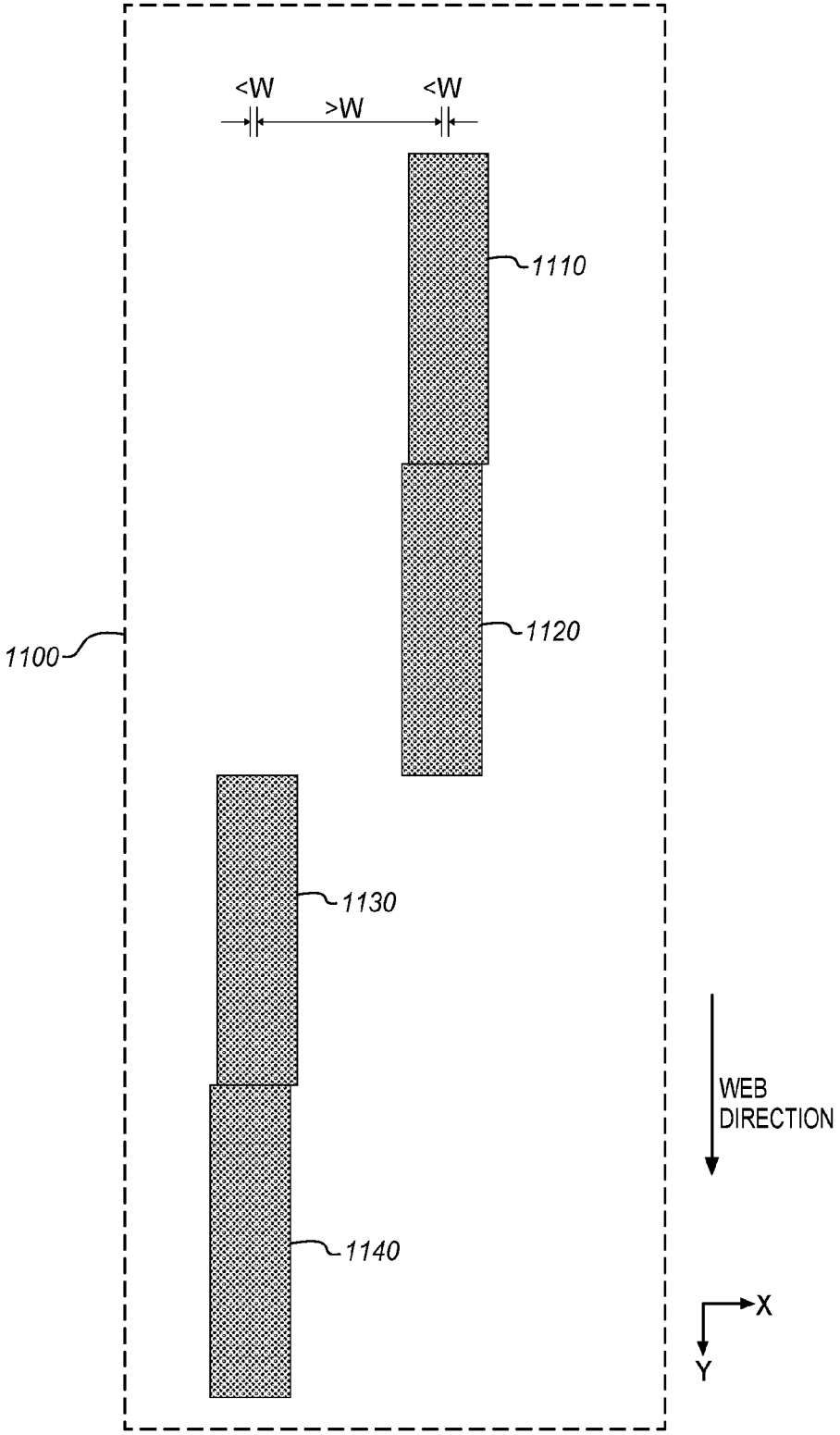
FIG. 11 is a diagram illustrating a partial test pattern printed by the nozzles of FIG. 10 in an exemplary embodiment.

FIGS. 10-11 illustrate an embodiment where misalignment occurs in the clockwise direction. In this embodiment, region 504 is misaligned clockwise by some amount 8 about an Axis of Rotation (AOR) relative to web 120. This means that nozzles 1010, 1020, 1030, and 1040 discharge ink onto a web of print media as indicated by lines 1012, 1022, 1032, and 1042 respectively. This results in nozzle 1010 depositing ink 1110, nozzle 1020 depositing ink 1120, nozzle 1030 depositing ink 1130, and nozzle 1040 depositing ink 1140, respectively, at partial test pattern 1100 of FIG. 11.

Figure 12:
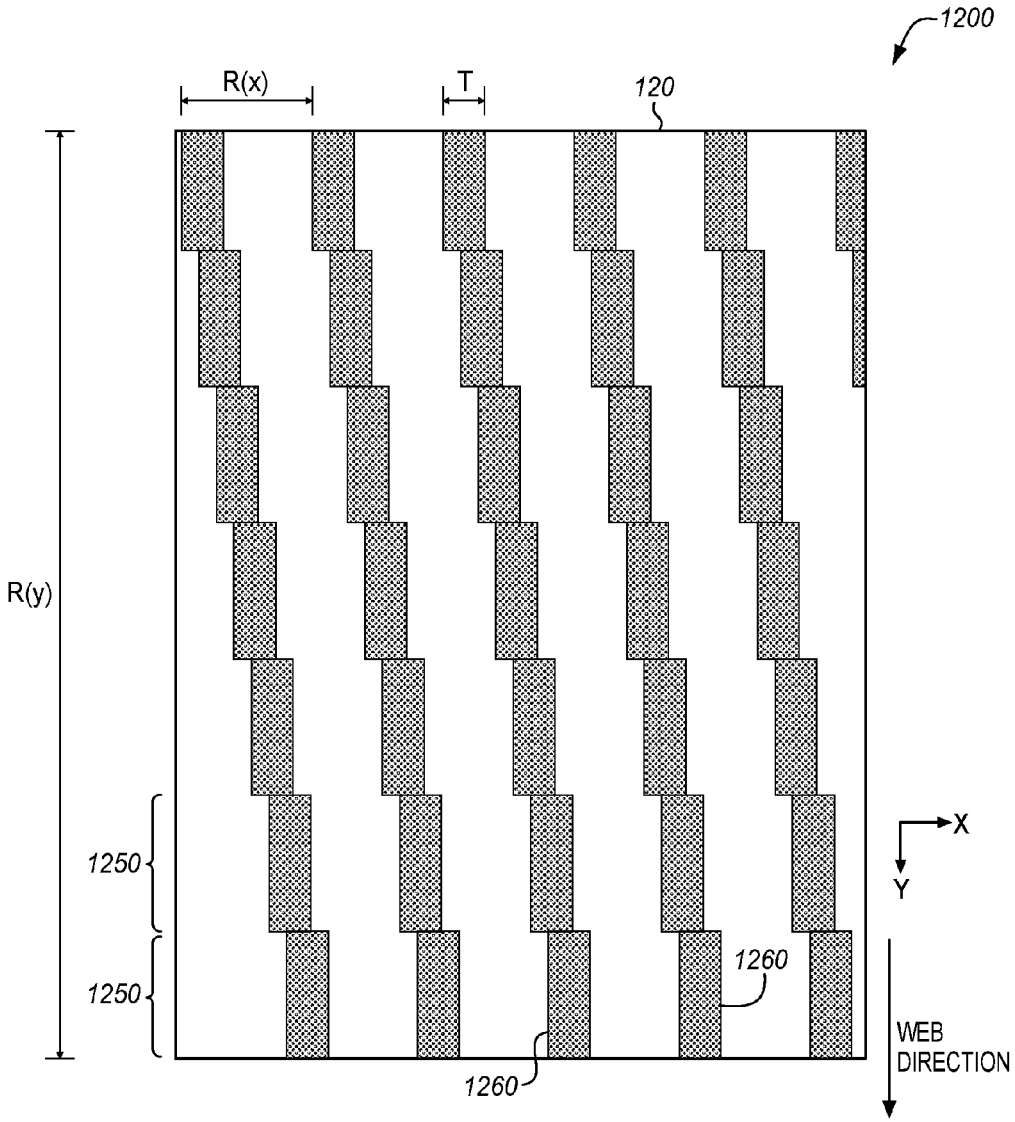
FIG. 12 is a diagram illustrating a full test pattern printed onto print media in an exemplary embodiment.

FIG. 12 is a diagram illustrating a full test pattern printed onto a web 120 of print media by one or more printheads in an exemplary embodiment. FIG. 12 may correspond, for example, with a web of print media marked with partial test pattern 700 of FIG. 7 for a nominal alignment condition of the nozzles. In this case, partial test pattern 700 has been printed such that each mark is composed of ink from adjacent nozzles, wherein a portion of each mark extends in the process direction into another mark. As shown in FIG. 12, a uniform density is exhibited along bands 1250. That is, each band 1250 includes the same ratio of inked portions 1260 and empty space at web 120. Furthermore, the marks proceed in a predictable and uniform stair-step pattern.

Test pattern 1200 includes multiple bands 1250. As shown in FIG. 12, each band 1250 includes multiple marks separated by empty space 120. The ratio of marked space to empty space remains constant across bands 1250. Each band 1250 extends along the X direction, and bands 1250 are separated along the Y direction. A full repetition of a full test pattern 1200 along the Y direction is referred to as R(y). A full repetition of a mark 1260 (and its corresponding empty space) along the X direction for a single band is referred to as R(x). In this embodiment, R(y) occupies the height of eight full bands. In contrast, R(x) is much smaller than R(y), which means that test pattern 1200 has a much higher visual spatial frequency along the X direction than along the Y direction. In this embodiment, the spatial frequency for a single band is R(y)/8=M(y). M(y) may be chosen to provide a visual spatial frequency that is between one and ten cycles per degree of visual field of view. This visual frequency is translated to the spatial frequency of the pattern (e.g. cycles per mm), which is used, in addition to the expected viewing distance (e.g., 15-25 inches), as a basis for generating a printed pattern. R(x) may be chosen to present a spatial frequency that is higher than ten (e.g., twenty to thirty) cycles/degree. Thus, the bands 1250 of test pattern 1200 repeat as a group in the direction of travel of the web at a first frequency to provide high contrast, and mark 1260 of the test pattern 1200 repeats in the lateral direction at a second frequency that is higher than the first frequency to ensure visual blurring.

In one embodiment, R(x) is less than 0.5 millimeters (mm) (e.g., 0.28 mm) corresponding to a visual spatial frequency of 28.5 cycles/degree, assuming an eighteen inch viewing distance. A distance between bands (i.e., M=R(y)/8) may be 3.175 mm corresponding to a visual spatial frequency of 2.5 cycles/degree. These sizes may ensure that when viewed at an expected reading distance by a print operator, individual marks 1260 within a band 1250 appear blurred. Since marks 1260 are small enough to be blurred to the human eye, the contents of burred bands 1250 each appear to be the same density. However, a print operator or maintenance person remains capable of distinguishing differences in apparent density between different bands 1250, because each band extends far enough along the Y direction to have a spatial frequency such that the density differences are easily distinguishable since it is within a range at which the human vision system has high contrast sensitivity. Hence, bands 1250 do not blur together, and remain distinguishable to the extent that changes in density may be detected. In one embodiment, a printhead array has a resolution of 720 DPI along the X direction, and has a center line spacing of eight pels in the X direction equal to 0.28 mm, and a height in the Y direction equal to 3.175 mm.

Figure 13:
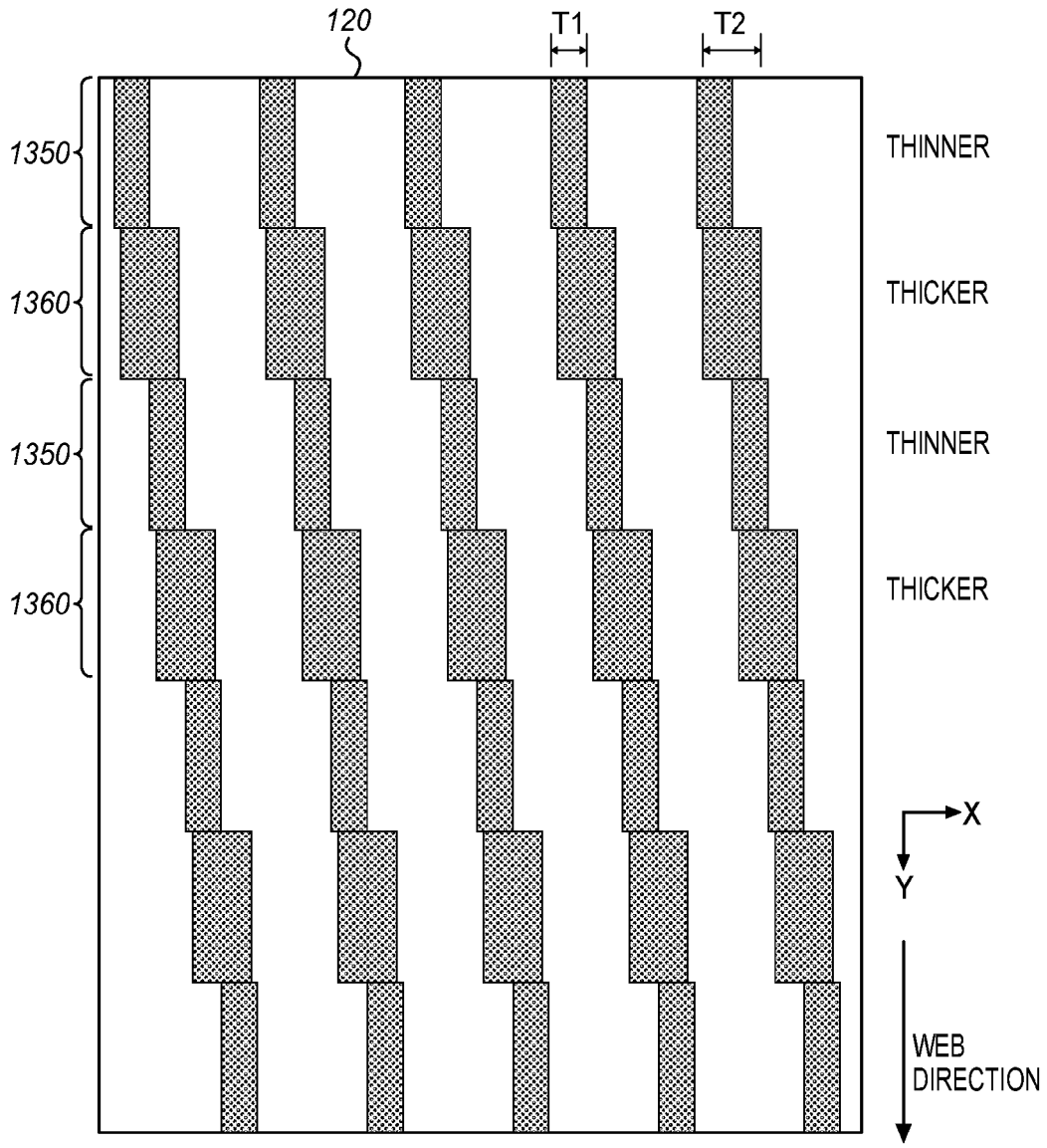
FIG. 13 is a diagram illustrating a full test pattern printed onto print media by a misaligned printhead in an exemplary embodiment.

FIG. 13 is a diagram illustrating a full test pattern generated by one or more misaligned printheads in an exemplary embodiment. As shown in FIG. 13, owing to the phenomenon illustrated for partial test patterns and described in FIGS. 7-11, nozzles that occupy different rows are displaced by varying amounts along the X direction when a corresponding printhead is misaligned with regard to underlying print media. When a full test pattern is printed that includes marks made from adjacent nozzles in different rows, this misalignment manifests itself by changing the thickness of marks in different bands. This change in thickness of the marks changes the percentage of area within the bands that is covered by ink, which changes the apparent density of the bands in the test pattern when viewed without magnification.

FIG. 13 illustrates that misalignment has caused neighboring bands 1350 and 1360 to have marks of different thickness. Specifically, bands 1350 have thinner marks (of thickness T1), and bands 1360 have thicker marks (thickness T2). Bands 1350 and 1360 alternate throughout web 120. The difference in thickness causes bands 1360 to appear darker than bands 1350. Thus, even for very small marks (e.g., marks that are two pels wide at 1200 DPI resolution), the print shop operator may visually detect misalignment by detecting changes in apparent density between neighboring/adjacent bands. As used herein, the "density" of a band is that which can be visually perceived by the naked eye or measured using a densitometer.

In further embodiments, the marks of a band may be formed by nozzles that eject different colors. In this multiple color case, a color change in the band occurs as a function of printhead misalignment, which can be observed visually and which can also be measured by use of a spectrophotometer. In this multi-color case, the mechanism resulting in color change is slightly different. When multiple colors are used, a mark includes of a partial mark formed by a first color, an overlapped region where the mark is formed by the first and second colors and a partial mark formed by only the second color.

In a further embodiment, the pair of nozzles that form each half of a mark are chosen such that they are located in rows which are separated in the direction of travel of the web by at least one other row (i.e., there is at least one row between the pair of adjacent nozzles). This ensures that the nozzles which discharge ink for each mark are separated by a significant distance along Y, which in turn emphasizes the amount of change in thickness found in bands 1350 and 1360 due to misalignment (e.g., angular deviation of the printhead with respect to the web, or vice-versa). When the printer dot gain is sufficiently high the ink applied by the pair of nozzles will appear to be a single mark to the naked eye.

Figure 14:
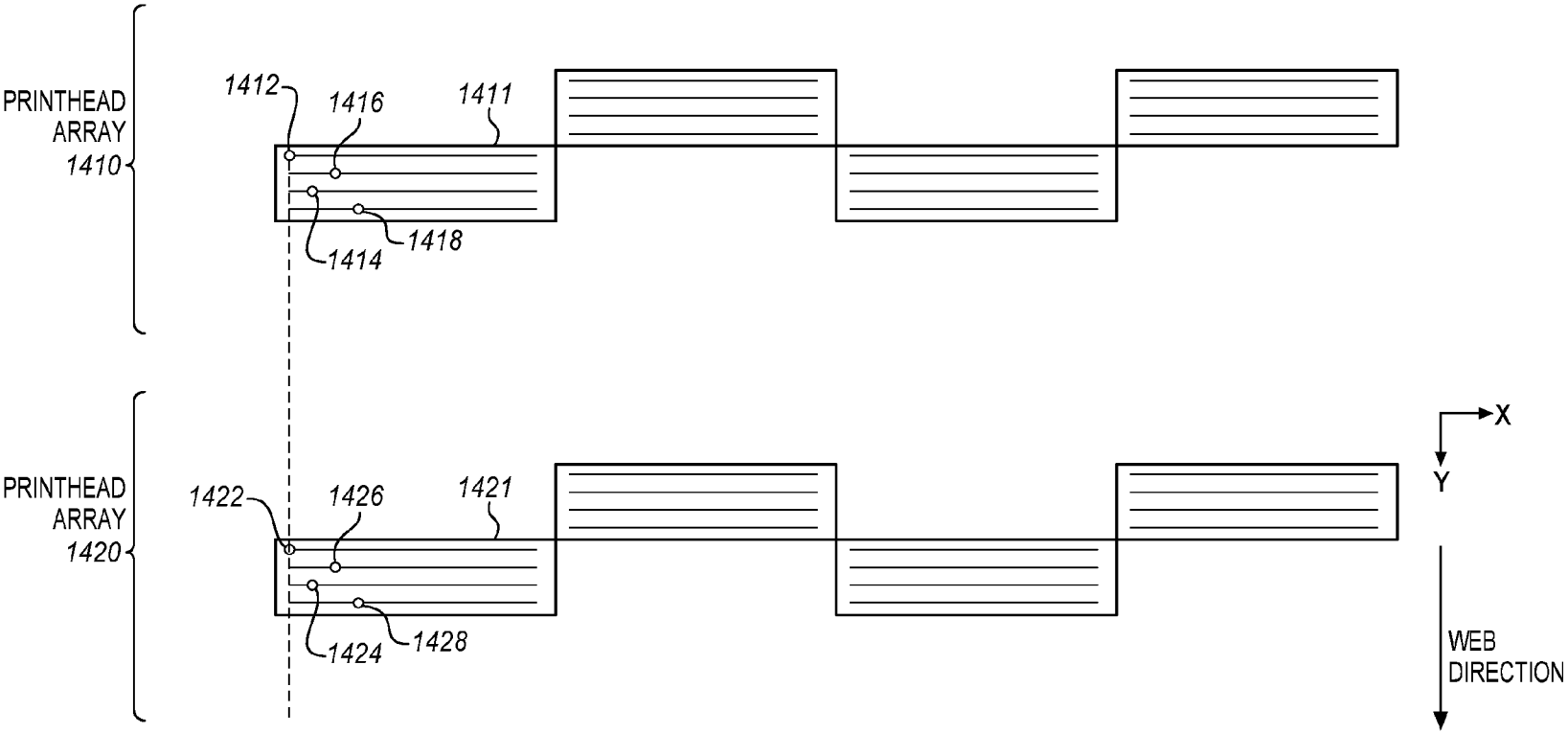
FIG. 14 is a diagram illustrating a printing system that includes multiple printhead arrays in an exemplary embodiment.

With the test patterns described and illustrated above, the following discussion describes how test patterns may be used to detect misalignment at a printer that includes multiple arrays of printheads. FIG. 14 is a diagram illustrating a printing system that includes multiple printhead arrays in an exemplary embodiment. In this embodiment, a printer includes a first printhead array 1410 and a second printhead array 1420. The nozzles of array 1410 align with the nozzles of array 1420 along the X direction, but are separated along the Y direction. This means that nozzle 1412 directly aligns with nozzle 1422 along the X direction, nozzle 1414 directly aligns with nozzle 1424 along the X direction, and so on.

Printheads may be limited to firing a specific number of times per second, owing to piezoelectric components that operate the nozzles of those printheads. In embodiments where the web proceeds at high speed through the printer, this arrangement provides a benefit in that it doubles the number of firings per unit of time provided by the printer along Y, and therefore doubles resolution of the printer along the Y direction. In this embodiment, array 1410 includes printhead 1411, having nozzles 1412, 1414, 1416, and 1418. Array 1420 includes printhead 1421, having nozzles 1422, 1424, 1426, and 1428. In order to test for various potential alignment issues, a controller of the printer may generate a full test pattern for printhead array 1410 to determine whether printheads 1411 are misaligned with respect to the web direction, and may separately generate a full test pattern for printhead array 1420 to determine whether printheads 1421 are misaligned with respect to the web direction. The alignment of all printheads 1411 in printhead array 1410 may not be the same. Misalignment of an individual printhead 1411 in a printhead array 1410 is identified using this alignment method and further observing density differences within a band 1350 of a full test pattern that correspond to marks produced by the nozzles (e.g. nozzle 1422, 1424, 1426 or 1428) of the individual printhead 1411. In further embodiments wherein printhead arrays 1410 and 1420 are slightly displaced (e.g. by ½ pel) in order to increase printer resolution along the x direction, the alignment method operates in the same manner as described above.

The controller may further test alignment of nozzles in separate marking structures (e.g. rows, printheads, arrays and/or marking engines) that have one or more nozzles intended to occupy the same position along the X direction. This may be achieved by having two or more marking structures print the same full test pattern at the same location on the web such that a marking structure "overprints" onto regions already marked by another marking structure. This technique should ideally be performed after the marking structures have already been individually aligned to account for misalignment of the individual marking structures. If marks in the test pattern are more thick or thin than expected, this indicates that a marking structure is displaced along the X direction with respect to another marking structure. Hence, misalignment can still be observed in this "dual pass" pattern which has ink contributions from two different marking structures, effectively doubling the ink coverage for a single mark.

In a further embodiment, controller 220 operates imaging device 222 (e.g., a camera, a spectrophotometer, densitometer, etc.) to acquire images of test patterns printed by printer 150. In this embodiment, controller 220 may determine that a row is misaligned with respect to the web in response to determining that marks in bands of the test pattern have a thickness that is different than a target value. Alternatively, controller 220 may determine that a row is misaligned with respect to the web in response to determining that marks in bands of the test pattern have a varying thickness (i.e., different amounts of thickness). That is, the amounts of thickness of the marks may vary between bands. In addition to measuring thickness of lines, the optical density or color of each row may be measured. This may be done in various ways. For example, densitometers are devices which are specifically used to measure density and spectrophotometers are devices used to measure color. In a further embodiment, one could also look at an average RGB value across each band via a scanner or camera, to identify differences between bands.

Figure 15:
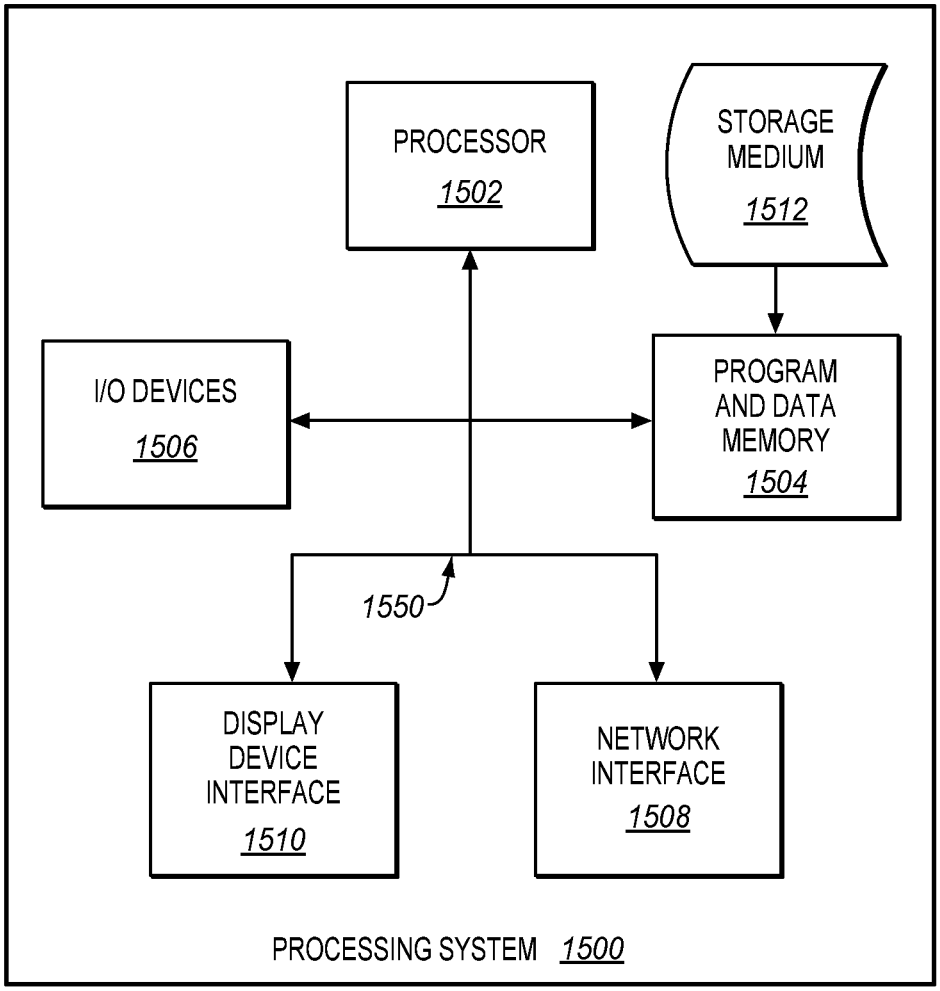
FIG. 15 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of printing system 100 to perform the various operations disclosed herein. FIG. 15 illustrates a processing system 1500 operable to execute a computer readable medium embodying programmed instructions to perform desired functions in an exemplary embodiment. Processing system 1500 is operable to perform the above operations by executing programmed instructions tangibly embodied on computer readable storage medium 1512. In this regard, embodiments of the invention can take the form of a computer program accessible via computer-readable medium 1512 providing program code for use by a computer or any other instruction execution system. For the purposes of this description, computer readable storage medium 1512 can be anything that can contain or store the program for use by the computer.

Computer readable storage medium 1512 can be an electronic, magnetic, optical, electromagnetic, infrared, or semiconductor device. Examples of computer readable storage medium 1512 include a solid state memory, a magnetic tape, a removable computer diskette, a random access memory (RAM), a read-only memory (ROM), a rigid magnetic disk, and an optical disk. Current examples of optical disks include compact disk—read only memory (CD-ROM), compact disk—read/write (CD-R/W), and DVD.

Processing system 1500, being suitable for storing and/or executing the program code, includes at least one processor 1502 coupled to program and data memory 1504 through a system bus 1550. Program and data memory 1504 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1506 (including but not limited to keyboards, displays, pointing devices, etc.) can be coupled either directly or through intervening I/O controllers. Network adapter interfaces 1508 may also be integrated with the system to enable processing system 1500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 1510 may be integrated with the system to interface to one or more display devices, such as printing systems and screens for presentation of data generated by processor 1502.

Although specific embodiments were described herein, the scope of the invention is not limited to those specific embodiments. The scope of the invention is defined by the following claims and any equivalents thereof.

We claim:

1. A system comprising:

a printer comprising:

a marking engine comprising rows of nozzles that eject ink onto a print medium, wherein the rows are separated from each other along a Y direction, and each row of nozzles extends in an X direction that is in-plane with the Y direction; and a controller that directs the marking engine to print multiple bands of a test pattern, wherein each band is printed by selecting nozzles in a first row at regularly spaced intervals, selecting nozzles in a second row that occupy adjacent X positions to the selected nozzles of the first row, and ejecting continuous lines of ink from the selected nozzles in the first row and the selected nozzles in the second row onto a print medium to form a band comprising multiple evenly spaced marks separated by empty space, each mark comprising a first continuous line from a nozzle in the first row and a second continuous line from a nozzle in the second row, at least a portion of the second continuous line shares Y coordinates with at least a portion of the first continuous line, and each band of the test pattern is printed by ejecting ink from a different combination of nozzles.

2. The system of claim 1 wherein:

the controller determines that a row is misaligned with respect to the print medium in response to determining that marks in bands of the test pattern have a thickness that is different than a target value.

3. The system of claim 1 wherein:

the controller determines that a row is misaligned with respect to the print medium in response to determining that marks in different bands of the test pattern have different amounts of thickness.

4. The system of claim 1 wherein:

for each mark, the continuous line from the nozzle in the first row comprises a first half of the mark in the X direction, and the continuous line from the nozzle in the second row comprises a second half of the mark in the X direction.

5. The system of claim 4 wherein:

the first half of a mark extends into a second band; and the second half of the mark extends into a third band.

6. The system of claim 4 wherein:

the first half and the second half of each mark are contiguous.

7. The system of claim 1 wherein:

neighboring bands of the test pattern are printed by combinations of rows that have at least one nozzle in common.

8. The system of claim 1 wherein:

the test pattern repeats in the Y direction at a first frequency; and each band of the test pattern includes a combination of mark and empty space that repeats in the X direction at a second frequency that is higher than the first frequency.

9. The system of claim 1 wherein:

the marking engine comprises printheads that remain stationary as the test pattern is printed.

10. The system of claim 1 wherein:

the first row and the second row are separated in the Y direction by at least one other row.

11. A method comprising:

selecting a marking engine comprising rows of nozzles that eject ink onto a print medium, wherein the rows are separated from each other along a Y direction, and each row of nozzles extends in an X direction that is in-plane with the Y direction; and directing the marking engine to print multiple bands of a test pattern, wherein each band is printed by:

selecting nozzles in a first row at regularly spaced intervals;

selecting nozzles in a second row that occupy adjacent X positions to the selected nozzles of the first row; and ejecting continuous lines of ink from the selected nozzles in the first row and the selected nozzles in the second row onto a print medium to form a band comprising multiple evenly spaced marks separated by empty space, each mark comprising a first continuous line from a nozzle in the first row and a second continuous line from a nozzle in the second row, at least a portion of the second continuous line shares Y coordinates with at least a portion of the first continuous line, and each band of the test pattern is printed by ejecting ink from nozzles in a different combination of nozzles.

12. The method of claim 11 further comprising:

determining that a row is misaligned with respect to the print medium in response to determining that marks in bands of the test pattern have a thickness that is different than a target value.

13. The method of claim 11 further comprising:

determining that a row is misaligned with respect to the print medium in response to determining that marks in different bands of the test pattern have different amounts of thickness.

14. The method of claim 11 wherein:

for each mark, the continuous line from the nozzle in the first row comprises a first half of the mark in the X direction, and the continuous line from the nozzle in the second row comprises a second half of the mark in the X direction.

15. The method of claim 14 wherein:

the first half of a mark extends into a second band; and the second half of the mark extends into a third band.

16. The method of claim 14 wherein:

the first half and the second half of each mark are contiguous.

17. The method of claim 11 wherein:

neighboring bands are printed by combinations of rows that have at least one row in common.

18. The method of claim 11 wherein:

the test pattern repeats in the Y direction at a first frequency; and each band of the test pattern includes a combination of mark and empty space that repeats in the X direction at a second frequency that is higher than the first frequency.

19. The method of claim 11 wherein:

the first row and the second row are separated in the Y direction by at least one other row.

20. The method of claim 11 further comprising:

holding printheads of the marking engine stationary as the test pattern is printed.

21. A non-transitory computer readable medium embodying programmed instructions which, when executed by a processor, are operable for performing a method comprising:

selecting a marking engine comprising rows of nozzles that eject ink onto a print medium, wherein the rows are separated from each other along a Y direction, and each row of nozzles extends in an X direction that is in-plane with the Y direction; and directing the marking engine to print multiple bands of a test pattern, wherein each band is printed by:

selecting nozzles in a first row at regularly spaced intervals;

selecting nozzles in a second row that occupy adjacent X positions to the selected nozzles of the first row; and ejecting continuous lines of ink from the selected nozzles in the first row and the selected nozzles in the second row onto a print medium to form a band comprising multiple evenly spaced marks separated by empty space, each mark comprising a first continuous line from a nozzle in the first row and a second continuous line from a nozzle in the second row, at least a portion of the second continuous line shares Y coordinates with at least a portion of the first continuous line, and each band of the test pattern is printed by ejecting ink from nozzles in a different combination of nozzles.

* * * * *